US005324594A

United States Patent [19]

Yasuda et al.

[11] Patent Number: 5,324,594

[45] Date of Patent: Jun. 28, 1994

[54] GALVANNEALED STEEL SHEETS EXHIBITING EXCELLENT PRESS DIE SLIDING PROPERTY

[75] Inventors: Akira Yasuda; Takaaki Hira, both of Chiba; Toshitake Hanazawa; Hiroaki Ueno, both of Kurashiki; Yoshihisa Serizawa, Toyota; Tadaaki Morishita, Toyota; Kazuyoshi Sato, Toyota, all of Japan

[73] Assignees: Kawasaki Steel Corporation, Hyogo; Toyota Jidosha Kabushiki Kaisha, Aichi, both of Japan

[21] Appl. No.: 967,431

[22] Filed: Oct. 28, 1992

[30] Foreign Application Priority Data

Oct. 30, 1991 [JP] Japan ..... 3-284513

[51] Int. Cl.[5] ..... C23C 2/06; B32B 3/00; B32B 15/18

[52] U.S. Cl. ..... 428/659; 428/687; 428/939

[58] Field of Search ..... 428/659, 600, 687, 612, 428/939, 624

[56] References Cited

U.S. PATENT DOCUMENTS

| | | | |
|---|---|---|---|
| 3,506,413 | 4/1970 | Uchida et al. | 428/659 |
| 4,775,599 | 10/1988 | Matsuoka et al. | 428/600 |
| 4,798,772 | 1/1989 | Furukawa | 428/687 |
| 5,011,744 | 4/1991 | Saito et al. | 428/687 |
| 5,019,460 | 5/1991 | Yasuda et al. | 428/659 |
| 5,182,171 | 1/1993 | Aoyama et al. | 428/659 |

FOREIGN PATENT DOCUMENTS

| | | | |
|---|---|---|---|
| 61-67794 | 4/1986 | Japan | 428/659 |
| 1-242765 | 9/1989 | Japan . | |
| 2-274854 | 11/1990 | Japan | 428/659 |
| 2-274855 | 11/1990 | Japan | 428/659 |
| 2-274856 | 11/1990 | Japan | 428/659 |
| 2-274859 | 11/1990 | Japan | 428/659 |
| 3-82746 | 4/1991 | Japan . | |
| 3-162492 | 7/1991 | Japan . | |

OTHER PUBLICATIONS

"Surface Texture (Surface Roughness, Waviness, and Lay)", American National Standard Institute, The American Society of Mechanical Engineers, New York, N.Y. ANSI/ASME B46.1-1985, pp. 32, 37.

H. Burst et al., "Hot-Dip Galvanized Sheet Steel in Automobile Manufacturing", Industrial Heating, Oct. 1981, pp. 39-40.

*Primary Examiner*—John Zimmerman

*Attorney, Agent, or Firm*—Oliff & Berridge

[57] ABSTRACT

In a hot-dip zinc-coated steel sheet exhibiting excellent press die sliding characteristics and obtained by performing a molten galvanization and then skin pass rolling on a surface of the steel sheet, a galvanized layer has a three-dimensional average surface roughness ranging from 0.7 μm to 1.4 μm, and a skewness (S) of the amplitude probability distribution of the surface roughness, which is defined by the following equation (1), ranging from 0.1 to −0.3:

$$S=\mu_3/\sigma^3 \quad (1)$$

where $\mu_3$: Three-dimensional moment of the amplitude probability density $\sigma$: Standard deviation of the amplitude probability density.

3 Claims, 4 Drawing Sheets

GALVANNEALED STEEL SHEETS EXHIBITING EXCELLENT PRESS DIE SLIDING PROPERTY

BACKGROUND OF THE INVENTION

1. Field of the Invention

The present invention relates to a hot-dip zinc-coated steel sheet, particularly, a galvannealed steel sheet which is suitable for use as an anti-corrosive steel sheet for automobiles and which exhibits an excellent press formability.

2. Description of the Prior Art

When a steel sheet is formed into an automobile car body by press forming it is important to consider the sliding characteristics of the steel sheet with respect to the press die. That is, when the sliding characteristics of the steel sheet deteriorate, the flow of the steel sheet into the press die is restricted, which will lead to a fracture of steel sheet material.

Particularly, when a hot-dip zinc-coated steel sheet has a zinc layer on the surface thereof, the sliding resistance thereof with respect to the die during press forming is larger than that of a cold rolled steel sheet, and the sliding characteristics thereof are relatively poor.

In a galvannealed steel sheet, in order to prevent peel-off of a galvannealed layer due to deformation of the steel sheet resulting from press forming, the degree of galvannealing is restricted to a low level to have the iron content of the galvannealed layer relatively low. Therefore, the sliding characteristics of the galvannealed layer with respect to the press die are negatively affected, and a material fracture often occurs during pressing. To eliminate such a problem, it has been proposed in Japanese Patent Laid-Open No. Hei 3-82746 to plate the galvannealed steel sheet with an alloy layer mainly consisting of Fe (iron) plating and thereby improve the sliding characteristics of the galvannealed layer with respect to the press die. In Japanese Patent Laid-Open No. Hei 3-162492, it has been proposed to coat the galvannealed steel sheet with rust-preventatives or press oil exhibiting an excellent lubrication property and thereby promote flow of the material.

Japanese Patent Laid-Open Hei 1-242765 discloses a steel sheet having a flat top portion which is 30 to 90% of the overall area on the surface thereof. The steel sheet exhibits an excellent press formability, as good as a plated steel sheet which has been subjected to an iron type plating.

However, adjustment of the surface roughness alone is not enough to improve the sliding characteristics of the steel sheet. Fe type plating conducted with an alloy layer, mainly consisting of iron, conducted on the steel sheet increases the cost of the material and affects chemical conversion as well as painting properties. Thus, application of such a plating on the entirety of a steel sheet for an automobile car body is not recommendable. Furthermore, since most of the rust preventatives or press oils which exhibit an excellent lubrication property cannot be readily removed, they may make the work in subsequent processes a troublesome one. The use of such a lubricant on some of the parts may be inhibited.

Thus, development of means for improving the press die sliding characteristics of the hot-dip zinc-coated steel sheet which eliminates problems involving the sliding characteristics during press forming when a normal rust-preventative or wash oil is used while restricting an increase in the material cost has been desired.

The sliding characteristics of the steel sheet with respect to the press die during press forming are affected by the properties and shape of the surface of the steel sheet as well as the lubrication effect obtained by using, for example, a press oil, a rust-preventative or a wash oil which is applied to the steel sheet. To improve the sliding property of the steel sheet, the general practice has been to utilize the lubrication effect of the liquid, such as a press oil or a rust-preventative, which is retained between the steel sheet and the press die by controlling the shape of the surface of the steel sheet. It is considered that in order to obtain the aforementioned lubrication effect, an increase in the average surface roughness (SRa) of the steel sheet is advantageous. However, excessive increases in SRa not only degrade the appearance of the steel sheet which has been subjected to coating but makes the lubricating effect nonuniform, deteriorating the press formability of the steel sheet or deforming the pressed part. Thus, an increase in the surface roughness alone of the steel sheet is not enough to obtain sufficient lubricating effect.

SUMMARY OF THE INVENTION

It is an object of the present invention to provide a hot-dip zinc-coated steel sheet, particularly, a galvannealed steel sheet which has excellent press die sliding characteristics and hence excellent press formability. The object is met by forming a surface profile on the steel sheet such that it can readily retain a liquid lubricant, such as rust-preventatives, and thereby allow a sufficient lubricating effect to be obtained. The average surface roughness is within a predetermined range.

The present invention provides a hot-dip zinc-coated steel sheet exhibiting excellent press die sliding characteristics and obtained by performing a hot-dip zinc-coating and then skin pass rolling. The hot-dip zinc-coated steel sheet is characterized in that a three-dimensional average surface roughness of the galvanized layer is between 0.7 μm and 1.4 μm, and in that a skewness (S) of the amplitude probability distribution of the surface roughness which is defined by the following equation (1) is between 0.1 and −0.3:

$$S=\mu_3/\sigma^3 \quad (1)$$

where $\mu_3$: Three dimensional moment of the amplitude probability density $\sigma$: Standard deviation of the amplitude probability density Other features and variations of the present invention will become clear from the following description taken in connection with the accompanying drawings.

DESCRIPTION OF THE PREFERRED EMBODIMENT

Figure 1:
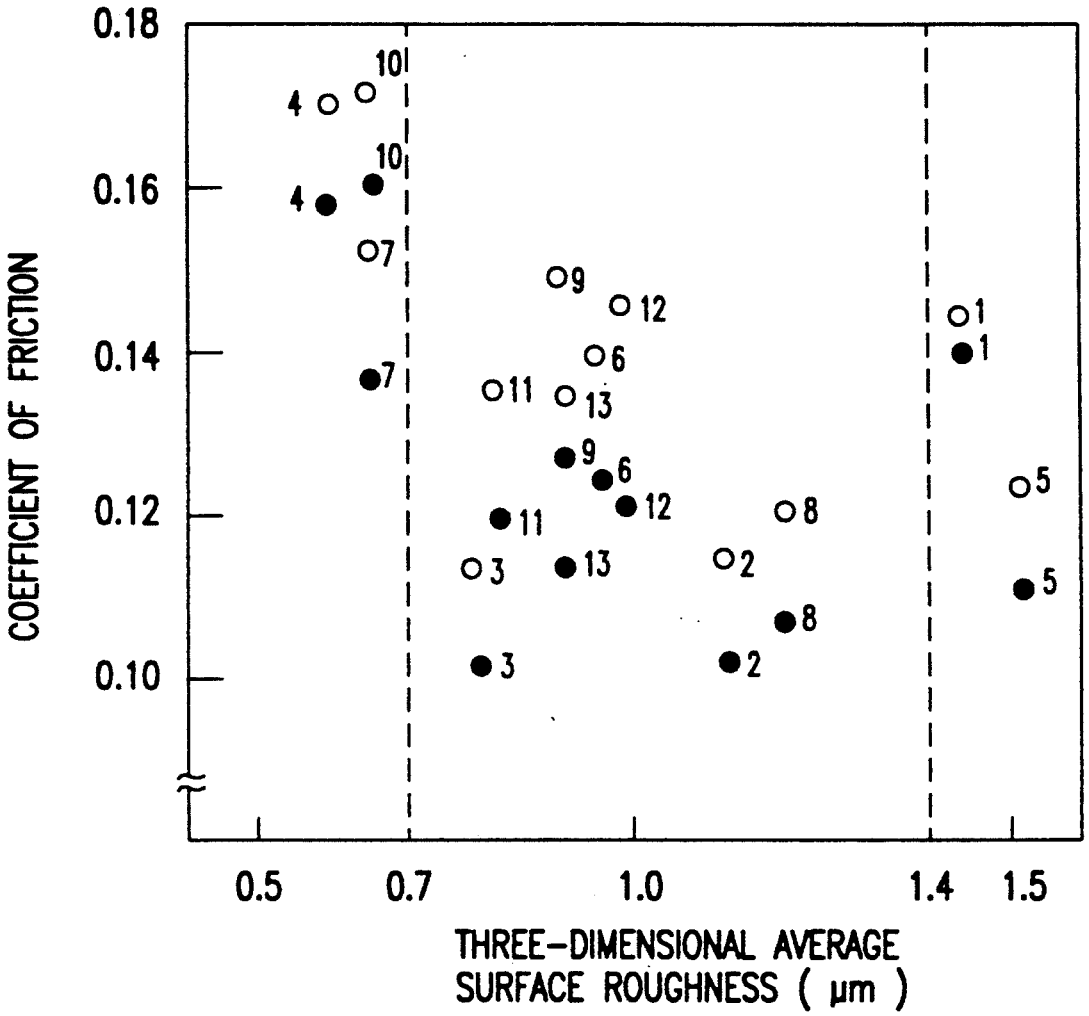
FIG. 1 shows the relation between the three-dimensional average surface roughness and the coefficient of friction in a galvannealed steel sheet.

The present invention will now be described in detail.

Since the sliding characteristics of a hot-dip zinc-coated layer on a steel sheet with respect to the press die are relatively inadequate, they must be improved by giving a special surface configuration to the galvanized layer.

In order to allow a liquid lubricant to be retained so as to obtain excellent press die sliding characteristics, the surface average roughness (SRa) of the galvanized layer must be 0.7 μm or above. An average surface roughness (SRa) of less than 0.7 μm readily slips when the blank sheet is transported or stacked by vacuum suction, lessening its workability. An average surface roughness (SRa) of more than 1.4 μm lessens the appearance of the surface of the steel sheet which has been subjected to coating and makes provision of uniform lubrication effect difficult, thereby partially generating relative restriction of the flow of the material and thus deteriorating the press formability unless a sufficient amount of lubricant is present. Thus, a preferable average surface roughness (SRa) is between 0.7 μm and 1.4 μm, with a more preferable range being between 0.7 μm and 1.1 μm.

However, the adjustment of the surface roughness (SRa) alone is not enough to obtain sufficient sliding characteristics.

The present inventors made intensive studies on the factors which affect the sliding characteristics of the hot-dip zinc-coated steel sheet, and discovered that the skewness (S) greatly affects the sliding characteristics.

That is, the present inventors found that, when the skewness (S) is within a predetermined range, the sliding characteristics and the coefficient of friction are reduced, thus greatly increasing the limiting drawing ratio (LDR). The LDR is the index with which the actual press formability of the steel sheet is evaluated.

Here, $S=\mu_3/\sigma^3$ is an index which is statistically a barometer of asymmetry of frequency distribution or probability distribution and is called skewness. The skewness (S) has been explained in, for example, "Outline of Mathematical Statistics" written by Ryoichi Sato (published in Mar. 10, 1940) on page 15 or "Industrial Mathematics Handbook" vol. 2 (published by Nikkan Kogyo Shinbunsha in Dec. 24, 1966) on page 116, both of which are hereby incorporated by reference.

That is, the present invention, where $f_i$ is the probability of appearance of samples having a surface roughness amplitude $x_i$ at N measuring points and $\bar{x}$ is the average value of x, the three-dimensional moment ($\mu_3$) of the amplitude probability density is given by $$\mu_3 = \frac{1}{N}\sum_{i=1}^{k} fi\,(xi - x)^3$$

The standard deviation ($\sigma$) of the amplitude probability density is given by $$\sigma = \sqrt{\frac{1}{N}\sum_{i=1}^{k} fi\,(xi - x)^2}\ .$$

The skewness (S) is calculated by the equation (1)

$$S=\mu_3/\sigma^3 \qquad (1)$$

When the average surface roughness (SRa) is within the aforementioned range, the effect of the lubricant applied to the steel sheet can be sufficiently obtained by setting the skewness (S) of the amplitude probability distribution of the surface roughness between 0.1 and −0.3, thus improving the sliding characteristics and assuring uniform and sufficient flow of the material, which results in provision of an excellent press formability.

Although the detailed mechanism by which the sliding characteristics of the hot-dip zinc-coated steel sheet are improved by control of the skewness (S) is not known, the present inventors, not wishing to be bound by any one theory, consider it as follows:

In a case where a surface profile of a hot-dip zinc-coated steel sheet in which the irregularities having a short period overlap with the convex portion of the irregularities having a long period, the skewness (S) of the surface roughness amplitude probability distribution is large. The convex portion of the irregularities having a long period is subjected to high pressure of the press die. If fine irregularities are present in the convex portion, supply and retaining of the lubricant on the contact surface are difficult, locally generating a high surface pressure and greatly deteriorating the sliding characteristics between the press die and the steel sheet.

Thus, it is necessary for the skewness (S) of the amplitude probability distribution of the surface roughness to be made equal to or less than a predetermined value, which is 0.1. On the other hand, in the case of a surface profile in which the concave portion of the irregularities having a long period is deep, the skewness (S) of the amplitude probability distribution of the surface roughness is small. In a surface profile having such a deep concave portion, in order to obtain sufficient effect of the lubricant, a larger amount of lubricant must be applied. However, it is very difficult to uniformly retain the large amount of lubricant. Non-uniform application of the lubricant generates non-uniform sliding characteristics and hence distortion or fracture of the press parts. Thus, where the average surface roughness is within a predetermined range, a surface profile having a very deep concave portion is not desirable, and the skewness (S) of the amplitude probability distribution of the surface roughness should therefore be made equal to or more than −0.3.

In order to control the average surface roughness and the amplitude probability distribution within an adequate range, setting the refining rolling conditions according to the surface roughness of the plating which has not yet been subjected to refining rolling conditions is essential. However, when a surface roughness is obtained by sufficiently transferring the roughness of the refining rolls onto the steel sheet, the absolute value of the skewness (S) of the amplitude probability distribution generally tends to be small. Essentially, the hot-dip zinc-coated steel sheet has a relatively large average surface roughness in a galvanized state and hence a large skewness of the amplitude probability distribution of the irregularities in the galvanized layer. It is therefore possible to obtain an adequate average surface roughness range and a small absolute value of the skewness (S) of the amplitude probability distribution by sufficiently transferring the roughness of the refining rolls onto the steel sheet.

TABLE 1

| No. | Average Surface Roughness (SRa) (μm) | Skewness of Amplitude Probability Distribution (S) | Forms of Amplitude Probability Distribution Curve | Coefficient of Friction (μ) | Limiting Drawing Ratio (LDR) | Remarks |
|---|---|---|---|---|---|---|
| 1 | 1.45 | 0.16 | Double peak type | 0.147 | 2.21 | Comparative example |
| 2 | 1.15 | 0.05 | Symmetry type | 0.115 | 2.36 | Example of this invention |
| 3 | 0.80 | −0.12 | Symmetry type | 0.115 | 2.36 | Example of this invention |
| 4 | 0.60 | −0.31 | Symmetry type | 0.170 | 2.01 | Comparative example |
| 5 | 1.51 | 0.05 | Symmetry type | 0.124 | 2.29 | Comparative example |
| 6 | 0.98 | −0.35 | Asymmetry type | 0.140 | 2.26 | Comparative example |
| 7 | 0.65 | −0.32 | Asymmetry type | 0.152 | 2.18 | Comparative example |
| 8 | 1.22 | −0.24 | Symmetry type | 0.123 | 2.33 | Example of this invention |
| 9 | 0.92 | 0.18 | Double peak type | 0.150 | 2.03 | Comparative example |
| 10 | 0.66 | −0.36 | Asymmetry type | 0.173 | 1.97 | Comparative example |
| 11 | 0.83 | −0.34 | Asymmetry type | 0.137 | 2.15 | Comparative example |
| 12 | 1.01 | 0.14 | Double peak type | 0.148 | 2.12 | Comparative example |
| 13 | 0.93 | −0.32 | Asymmetry type | 0.135 | 2.19 | Comparative example |

In the skin pass rolling performed to reduce the absolute value of the skewness (S), it is necessary to reduce the tension (T) and increase the reduction (R), unlike the conventional skin pass rolling method.

Thus, it is possible to obtain excellent sliding characteristics and hence improve the press formability without giving consideration to the lubrication effect of rust preventatives or a wash oil by using a hot-dip zinc-coated steel sheet whose surface profile is controlled in the manner described above. Furthermore, it is possible to further improve the press formability by combining the surface profile with another method of improving the sliding characteristics, such as plating an Fe-rich layer on the galvanized layer or application of an anti-corrosive oil having an excellent lubrication property.

In a galvannealed steel sheet, the proportion (the average proportion) of iron in the galvanized layer is limited to between 7 wt % and 12 wt % in order to obtain excellent surface appearance and excellent adhesion of the galvannealed layer which is suitable to press forming. An iron proportion of less than 7 wt % partially separates from the zinc metal phase, which can be the cause of an irregular appearance. An iron proportion of more than 12 wt % deteriorates the adhesion of the galvannealed layer, which leads to peeling-off of the galvannealed layer by the pressing. Peeled powder of the galvannealed layer can damage the formed steel part.

EXAMPLES

Examples of the present invention will be described below.

Samples of galvannealed steel sheets having various surface profiles as shown in Table 1 were manufactured by adjusting the reduction as well as the tension of the skin pass rolling process and roughness of the rolls. In each of the manufactured steel sheets, an extra low carbon steel sheet was used as the mother steel sheet. Each of the manufactured steel sheets was a steel sheet for deep drawing which was galvanized at a rate of 60 $g/m^2$ and which had a thickness of 0.8 mm.

Regarding the mechanical properties obtained by tension tests of each of the-manufactured steel sheets, Yield Strength, YS (MPa) was between 142 and 153, Tensile Strength, TS (MPa) was between 302 and 320, and Elongation, El (%) was between 46 and 49. The samples have substantially the same pressing property as the material except for the surface property.

Table 1 lists the three-dimensional average surface roughness (SRa), skewness (S) of the amplitude probability distribution, coefficient of friction (μ) and limiting drawing ratio (LDR) of each of the samples.

(1) Relationship between the average surface roughness (SRa) and coefficient of friction (μ).

The coefficient of friction between the press die and the sample was measured by measuring the pulling force required to pull the sample of the galvannealed steel sheet containing 11% or less of Fe. The sample was held between a flat tool and columnar tool having a radius of 20 mm. The flat tool and columnar tool were manufactured from the same material as the press die. Normally used rust preventatives and highly-lubricating rust preventatives were used as the lubricant. The results of the measurements are shown in FIG. 1.

In the Figure, ° indicates the relationship obtained when the normally used rust preventative (Nockthrust 530F40, manufactured by Parkar Kosan K.K.) was used, and • indicates the relationship obtained when the highly-lubricating rust preventative (Nockthrust 550HN, manufactured by Parkar Kosan K.K.) was used. As the average surface roughness (SRa) increases, the coefficient of friction (μ) decreases, improving the sliding characteristics (SRa). However, when the average surface roughness (SRa) is very large, the sliding characteristics do not improve even if a highly-lubricating rust preventative was used. Thus, an average surface roughness of 1.4 μm or less is desirable. The coefficient of friction greatly varies even when the average surface roughness is between 0.7 μm and 1.4 μm.

(2) Influence of the skewness (S) of the amplitude probability distribution on the sliding characteristics.

Although the sliding characteristics can be evaluated by the coefficient of friction (μ), they can also be evaluated by the limiting drawing ratio (LDR) which is the index with which the deep-drawability during the actual deep drawing process is evaluated.

It was confirmed according to this example that the skewness (S) of the amplitude probability distribution affects the sliding characteristics and that the limiting drawing ratio (LDR) is thus improved when the skewness (S) of the amplitude probability distribution is within a predetermined range.

Figure 2:
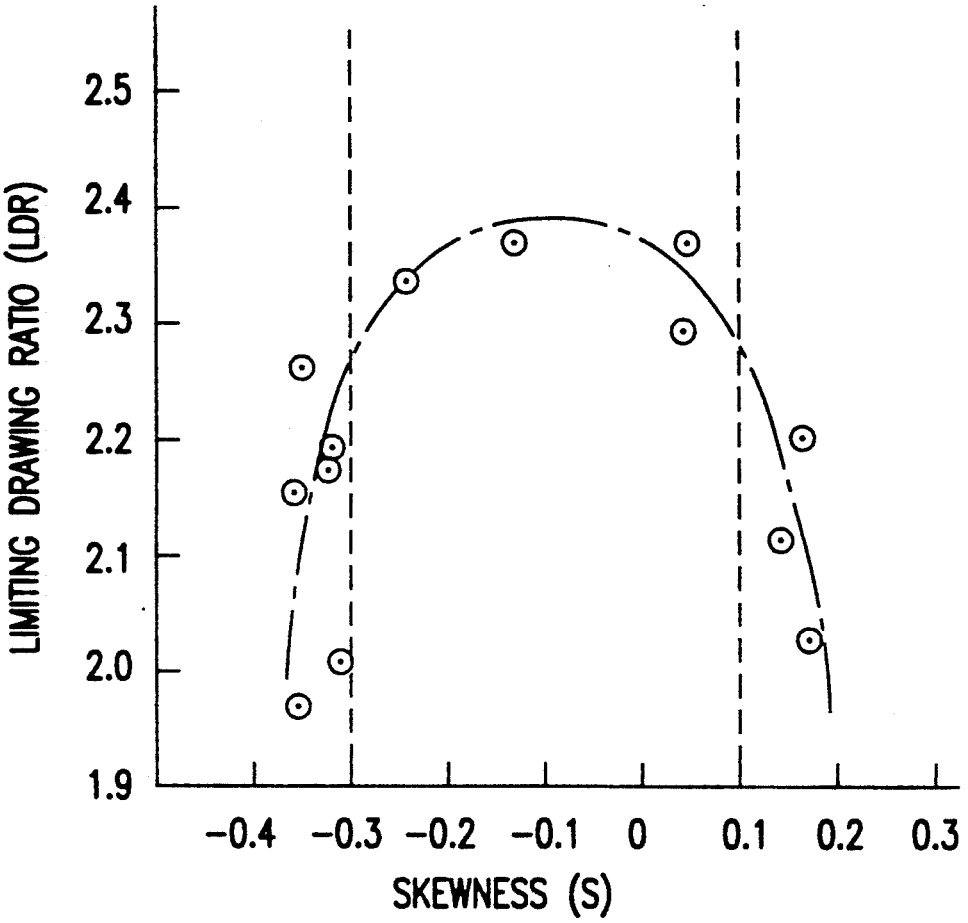
FIG. 2 is a graph showing the relation between the skewness of the amplitude probability distribution and the limiting drawing ratio (LDR) in a hot-dip zinc-coated galvannealed steel sheet.

As shown in FIG. 2, the skewness (S) of the amplitude probability distribution of each of the steel sheets which assured excellent limiting drawing ratio (LDR) was between 0.1 and −0.3.

Figure 4A:
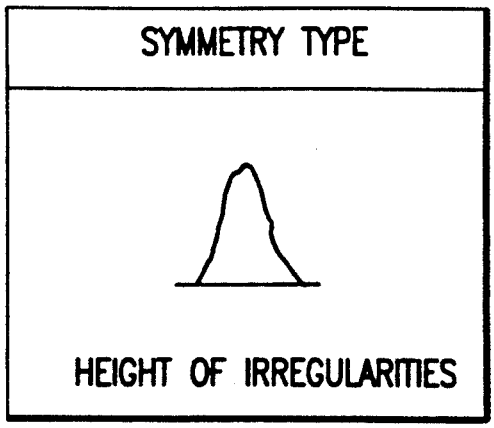
FIGS. 4A, 4B and 4C are three types of amplitude probability distribution curves of surface profiles of galvannealed steel sheets.
Figure 4B:
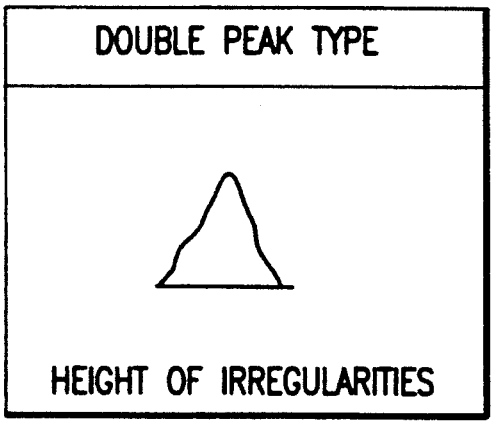
Figure 4C:
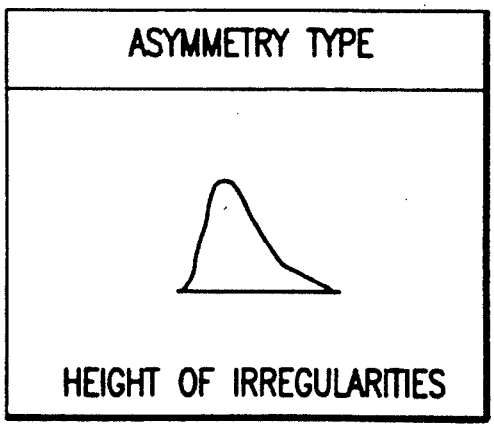

When a straight line crosses an irregularity curve of the surface profile at a certain height, the number of intersections of that straight line and the irregularity curve is a frequency of that height. The amplitude probability distribution is a probability distribution of the frequencies obtained at various heights as the number of intersections. An amplitude probability distribution curve is a histogram which expresses the frequencies with respect to the various heights. Amplitude probability distribution curves of the surface profiles of the galvannealed steel sheets are classified into three types, as shown in FIGS. 4A, 4B and 4C.

When the skewness (S) of the amplitude probability distribution is small and hence the sliding characteristics are good, a relatively symmetrical distribution is obtained.

In the case of a steel sheet having a skewness (S) of an amplitude probability distribution of 0.1 or above, the distribution density is high in the convex portion of the surface roughness. This means that the irregularities of the galvanized layer remain after the skin pass rolling process. As a result, it is considered that, even if the average surface roughness is within an adequate range, the lubricant retaining ability is reduced, thus deteriorating the sliding characteristics.

In the case of a steel sheet having a skewness (S) of an amplitude probability distribution of −0.3 or below, deep concave portions are present in the surface roughness, and the lubricant is absorbed by the deep concave portions. It is thus considered that a normal amount of lubricant does not assure a sufficient lubrication effect and that the sliding characteristics are thus reduced. That is, in order to obtain a surface profile having an excellent symmetry of irregularities which assure excellent sliding characteristics of the lubricant, it is necessary for the skewness Of the amplitude probability distribution to be set between 0.1 and −0.3.

(3) The relationship between the proportion of Fe in the galvannealed steel sheet and the press formability thereof.

Figure 3:
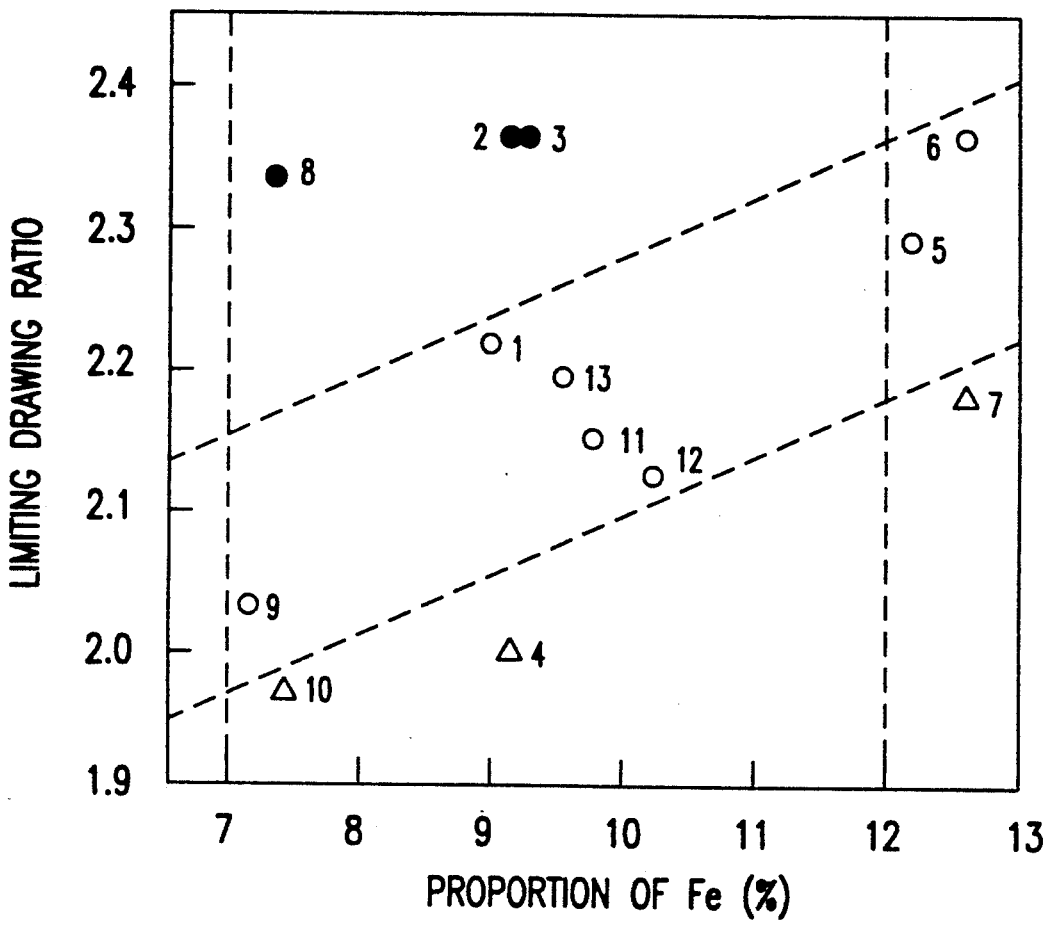
FIG. 3 is a graph showing the relation between the Fe concentration in the galvannealed layer and the limiting drawing ratio (LDR).

FIG. 3 shows the results of the measurements of the limiting drawing ratio of each of the samples which were conducted by performing a flat-bottomed cylindrical drawing test having a punch diameter of 33 mm on the sample. A normally-used rust preventative (Nockthrust 530F40, manufactured by Parkar Kogyo K.K.) was used as the lubricant. The pressure-pad-force was 0.5 t. The digit given to each of the symbols in the Figure is the sample number shown in Table 1. The abscissa of the graph shown in FIG. 3 represents the proportion (wt %) of Fe in the galvannealed layer. As can be seen in FIG. 3, although the steel sheets have substantially the same mechanical property, they have different limiting drawing ratios and hence different press forming properties. It is considered that a difference in the limiting drawing ratio is generated due to a difference in the sliding characteristics between the press die and the steel sheet. As long as the surface profile is substantially the same, as the proportion of Fe in the galvannealed layer increases, the limiting drawing ratio is further improved (indicated by "o"). However, a proportion of Fe exceeding 12 wt %, like sample Nos. 5, 6 and 7, deteriorates adhesion of the galvannealed layer and is thus not practical as a steel sheet for press forming, as shown in Table 2. The sample Nos. 4, 7 and 10 indicated by symbol "Δ" are those having an average surface roughness of less than 0.7 μm. The steel sheets having a small average surface roughness have a small limiting drawing ratio and hence a degraded press formability, as long as the proportion of Fe is the same. Thus, average surface roughness (SRa) of 0.7 μm or above is required.

In sample Nos. 2, 3 and 8 shown in FIG. 3, the skewness (S) of the amplitude probability distribution is within a predetermined range, and the press formability is excellent.

(4) Actual press test.

Continuous press was conducted on sample Nos. 2 and 3 of the examples of the present invention and on sample Nos. 11, 12 and 13 of the comparative examples to manufacture the rear floors of car bodies. Pressing conditions were the same, and a normally-employed rust preventative (Nockthrust 530F40, manufactured by Parkar Kogyo K.K.) was applied at a rate of 1.2 g/m$^2$. Table 3 shows the results of the measurements. Sample Nos. 2 and 3 of the examples of the present invention, exhibiting a small coefficient of friction and excellent sliding characteristics, showed excellent and stable formability in the continuous pressing operation. In sample Nos. 11, 12 and 13 of the comparative examples, having degraded sliding characteristics, a large amount of heat was generated in the presses die by continuous pressing, and the press formability gradually deteriorated, finally generating a fracture in the steel sheets.

TABLE 2

| No. | Average Surface Roughness (SRa) (μm) | Fe Proportion in Galvanized Layer | Adhesiveness of Galvanized Layer | Remarks |
|---|---|---|---|---|
| 1 | 1.45 | 9.1 | Good | Comparative example |
| 2 | 1.15 | 9.3 | Good | Example of this invention |
| 3 | 0.80 | 9.4 | Good | Example of this invention |
| 4 | 0.60 | 9.2 | Good | Comparative Example |
| 5 | 1.51 | 12.3 | Not Good | Comparative Example |
| 6 | 0.98 | 12.7 | Not Good | Comparative Example |
| 7 | 0.65 | 12.6 | Not Good | Comparative Example |
| 8 | 1.22 | 7.5 | Good | Example of this invention |
| 9 | 0.92 | 7.2 | Good | Comparative Example |
| 10 | 0.66 | 7.4 | Good | Comparative Example |
| 11 | 0.83 | 9.8 | Good | Comparative Example |
| 12 | 1.01 | 10.3 | Good | Comparative Example |
| 13 | 0.93 | 9.6 | Good | Comparative Example |

TABLE 3

| Steel Sheet No. | Results of Continuous Pressing |
|---|---|
| 2 | No cracks occurred in 500 pieces |
| 3 | No cracks occurred in 500 pieces |
| 11 | A crack occurred in 155 pieces and the operation was suspended |
| 12 | A crack occurred in 170 pieces and the operation was suspended |
| 13 | A crack occurred in 220 pieces and the operation was suspended |

As will be understood from the foregoing description, in a hot-dip zinc-coated steel sheet, particularly a galvannealed steel sheet according to the present invention, a sufficient lubrication effect of, for example, rust preventatives or a wash oil is obtained by controlling the surface roughness of and symmetry of the irregularities in the surface profile of the steel sheet within a predetermined range. Thus, the sliding characteristics with respect to the press die and hence the press formability is improved, particularly the continuous press formability. Furthermore, since the surface profile can be controlled by adjusting the galvanization, alloying and refining rolling conditions in the conventionally employed manufacturing process, control of the surface profile is possible without increasing the production cost. Also, control of the surface profile can be combined with coating of a lubricating plated layer on the galvanized layer or any other lubrication treatment. It is thus possible for the present invention to be extensively applied in various industrial fields.

What is claimed is:

1. A galvannealed steel sheet having sliding characteristics with respect to a press die, comprising a galvannealed layer containing from about 7 wt % to about 12.0 wt % of Fe, wherein an average three-dimensional surface roughness (SRa) of the galvannealed layer is from about 0.7 μm to about 1.4 μm and a skewness (S) of an amplitude probability distribution of surface roughness is from about 0.1 to about −0.3, said skewness being defined by the following equation (1):

$$S=\mu_3/\sigma^3 \quad (1);$$

wherein, $\mu_3$ is three-dimensional moment of the amplitude probability density and $\sigma$ is standard deviation of the amplitude probability density.

2. A galvannealed steel sheet according to claim 1, wherein an oil having lubricating properties is applied on the galvannealed layer.

3. A galvannealed steel sheet according to claim 1, having mechanical properties as follows:

yield strength (MPa) is from about 142 to about 153, tensile strength (MPa) is from about 302 to about 320, and elongation (%) is from about 46 to about 49.

* * * * *